United States Patent [19]

Hoyt

[11] 3,998,559

[45] Dec. 21, 1976

[54] DISPOSABLE FOUNTAIN APPLICATOR

[76] Inventor: Earl Hoyt, 127 E. Crescent Ave., Ramsey, N.J. 07446

[22] Filed: July 28, 1975

[21] Appl. No.: 599,469

[52] U.S. Cl. ..... 401/132; 401/196

[51] Int. Cl.[2] ..... A47L 13/17

[58] Field of Search ..... 401/196, 132–134; 128/269

[56] References Cited

UNITED STATES PATENTS

| | | | |
|---|---|---|---|
| 3,326,180 | 6/1967 | Lofgren | 401/134 X |
| 3,386,793 | 6/1968 | Stanton | 401/132 |
| 3,485,562 | 12/1969 | Hidden | 401/196 X |

*Primary Examiner*—Lawrence Charles
*Attorney, Agent, or Firm*—Howard C. Miskin

[57] ABSTRACT

A fountain applicator includes a flexible polyurethane foam head having cemented to its top face a frangible film to which is cemented along its border an upwardly directed liquid reservoir having a bottom opening and divided into a pair of compartments by a pair of medial panel walls converging downwardly to a transverse apex. The film may be ruptured selectively by controlled pressing the film against the apex by pressing in the sponge head. In another form the medial conveying walls are united and a central opening is formed in the film which need not be frangible and has a passageway between the sponge head and the film extending between the opening and the edge of the reservoir. A flexible band extends along the passageway and has its inner end folded under and joined to the border of the opening by pressure sensitive adhesive.

5 Claims, 5 Drawing Figures

FIG. 1
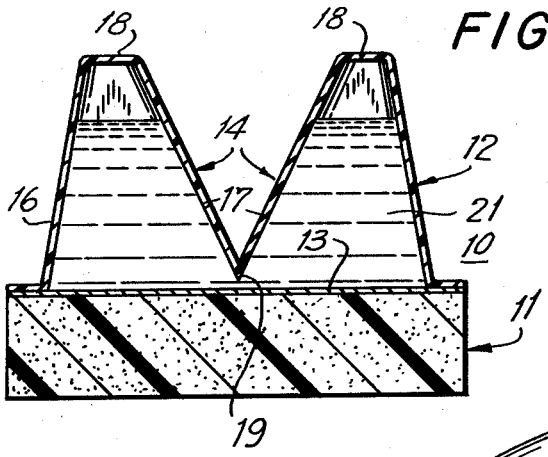
FIG. 2
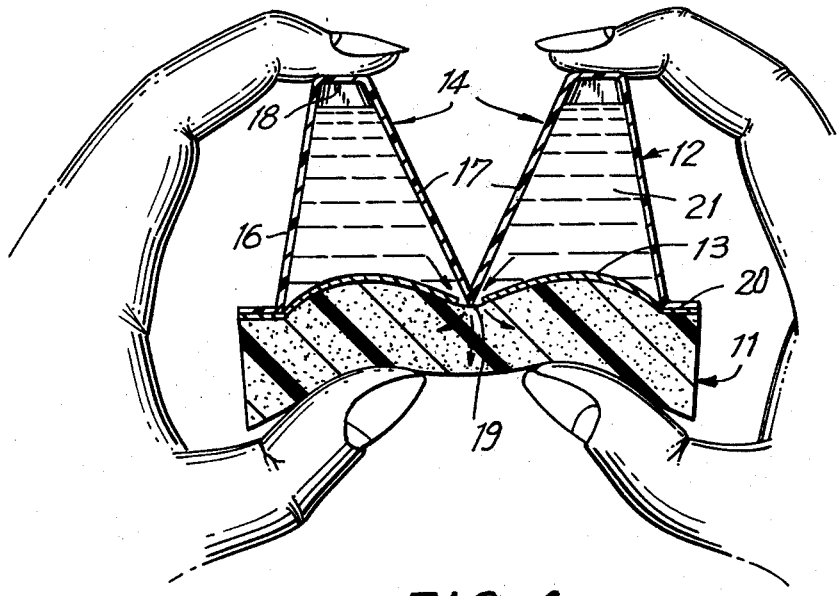
FIG. 3
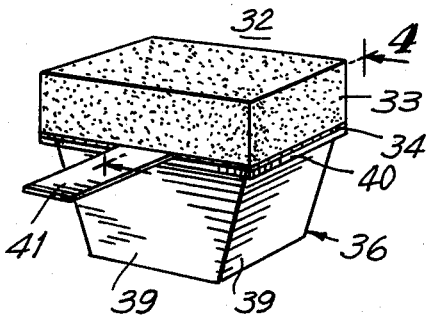
FIG. 4
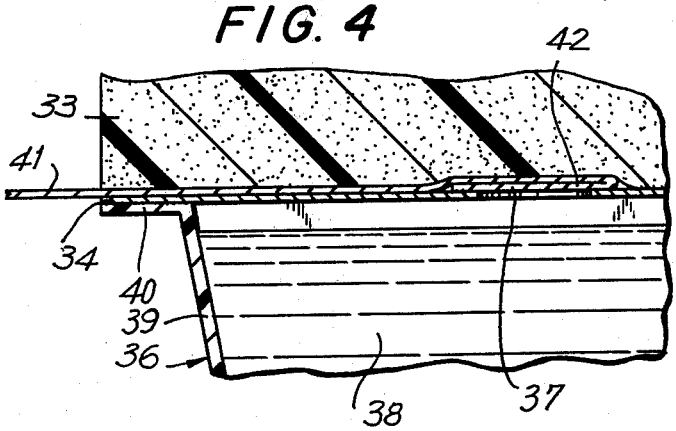
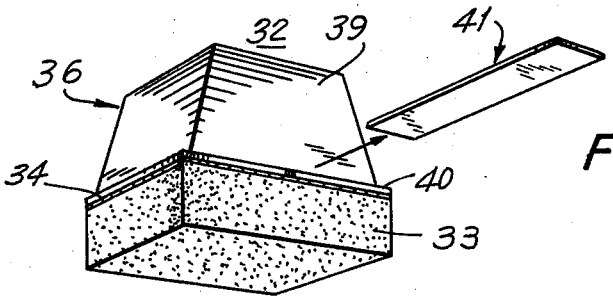
FIG. 5

DISPOSABLE FOUNTAIN APPLICATOR

BACKGROUND OF THE INVENTION

The present invention relates generally to improvements in applicator devices and it relates generally to an improved fountain applicator having a compressable sponge applicator or sponge member.

It is a common practice in the cleaning, polishing or coating of a work surface to apply a corresponding liquid to the work surface by a soft liquid absorbing pad or sponge and to spread the liquid over the work surface by moving the sponge over the surface. The amount of liquid applied and the uniformity of the spread liquid depends on the amount of liquid initially applied and if this is inadequate, additional liquid must be applied, an inconvenient time consuming and awkward procedure. Many fountain type of liquid applicator devices have heretofor been proposed and available but these possess numerous drawbacks and disadvantages. They are generally unreliable devices which present many difficulties in storing and shipping and are frequently difficult to use, are of limited application and little versatility, are often complicated and expensive and otherwise leave much to be desired.

SUMMARY OF THE INVENTION

It is a principal object of the present invention to provide an improved applicator device.

Another object of the present invention is to provide an improved fountain type liquid applicator device.

Still another object of the present invention is to provide an improved fountain type liquid applicator provided with a liquid reservoir having a closure which hermetically seals the reservoir and which is easily selectively broken or opened to provide full communication between the reservoir and the device applicator head.

A further object of the present invention is to provide a device of the above nature characterized by its reliability, ruggedness, simplicity, ease of fabrication, low cost and great versatility and adaptability.

In a sense the present invention contemplates the provision of a fountain type liquid applicator device comprising a liquid absorbent, flexible porous sponge head having a top face, a flexible frangible sheet overlying and secured to the sponge head top face and a liquid reservoir located atop the sheet and having a bottom opening with a peripheral border in liquid tight seal with the sheet, the reservoir having inner walls converging to an apex proximate the sheet, whereby compression of the sponge and reservoir effects the piercing of the sheet by the apex to fracture the sheet and provide a communication opening between the reservoir and sponge head. In another form, the apex forming walls are omitted and a central discharge opening is formed in the sheet which defines the reservoir bottom wall. The sheet is cemented to the sponge head top face except along a passageway between the discharge opening and outer edge of the sponge head top face. A flexible closure band extends along the passageway to the discharge opening and has its inner end folded over and hermetically sealed to the discharge opening border by a pressure sensitive adhesive.

The improved fountain type applicator devices are reliable simple, rugged, of low cost, easy to control the amount of pre-rung, and easy to fabricate and are of great versatility and adaptability.

BRIEF DESCRIPTION OF THE DRAWINGS

FIG. 1 is a medial vertical longitudinal sectional view of a preferred embodiment of the present invention shown in a sealed state;

FIG. 2 is a view similar to FIG. 1 showing the manipulation thereof in opening the seal;

FIG. 3 is an inverted perspective view of another embodiment of the present invention;

FIG. 4 is a fragmented enlarged sectional view taken along line 4—4 in FIG. 3; and FIG. 5 is a perspective view showing the reservoir closure member in a withdrawn position.

DESCRIPTION OF THE PREFERRED EMBODIMENTS

Referring now to the drawings particularly FIGS. 1 and 2 thereof which illustrate a preferred embodiment of the present invention, the reference numeral 10 generally designates the improved fountain type applicator device, which includes a liquid or water absorbent flexible, compressible, soft liquid absorbent porous sponge head 11, a liquid containing reservoir 12, and a flexible frangible reservoir closure sheet 13.

The sponge head 11 is advantageously in the form of a rectangular block with a flat rectangular top face and an opposing bottom face and is formed of any suitable open pore, soft flexible synthetic sponge material, such as open pore, soft polyurethane or polyvinyl chloride foam or the like. Superimposed on and coinciding with the top face of sponge block 11 is the thin frangible flexible liquid impervious closure sheet 13 which is formed of any suitable material such as polyethylene, polyvinyl chloride, thin metal foil or the like. The sheet 13 is firmly secured to the sponge block top face by a suitable cement which is compatible with the sponge block and the reservoir, and is resistant to the action of the liquid contained in the reservoir. The cement may be of the heat sensitive or other type.

The reservoir 12 is open at its bottom and is formed of a rigid or semirigid synthetic organic polymeric sheet, such as polystyrene, polypropylene or the like, advantageously by thermoforming or other suitable process. The reservoir is illustrated as being symmetrical to a medial transverse axis and having two similarly shaped sections or compartments 14 communicating with each other along the bottoms. Each section 14 includes a downwardly outwardly inclined rectangular outer wall 16 and a downwardly inwardly inclined inner wall 17, the tops of walls 16 and 17 being joined by a narrow horizontal top wall 18. The inner walls 17 converge downwardly to a sharp transversely extending medial apex 19 which is normally disposed a short distance above the face of sheet 13 in the unstressed condition of the device 10. The reservoir 12 includes front and rear walls and an outwardly directed coplanar peripheral flange 20 which extends along the bottom edges of the reservoir front and rear walls and outer walls 16 and is suitably cemented in a liquid sealing condition to the top peripheral border of the sheet 13 in any suitable manner.

The reservoir 12 contains any desired liquid 21, for example a liquid detergent, polish or cleansing liquid or solvent or the like.

In the initial unused state of the fountain sponge device 10 as shown in FIG. 1, the sheet 13 is in an imperforate condition, so that the reservoir 12 is completely closed and sealed by the sheet 13 and the liquid 21 contained in the reservoir 12 is thus preserved. In the application of the improved device 10, the operator merely grasps the top and bottom faces of the device 10 between the thumb and forefinger of each hand, as shown in FIG. 2, and compresses the device to longitudinally stress the sheet 13 by undulating it by way of the sponge head 11 and pressing it against the apex 19. The longitudinal stress in the sheet 13 and the pressure therein by the apex 19 fractures or severs the sheet 13 along a transverse line less than the full width of sponge head 11 to provide a liquid discharge opening between the reservoir 12 and the sponge head 11. The structure disclosed allows the user to control the pressure applied for separating the sheet 13 to control the size of the fracture and hence the flow of liquid.

When the closure sheet opened device 10 is employed, the reservoir 12 which defines a handle is grasped and the underface of the sponge head is moved along the face of a work surface. Vertical compression and release of the sponge head 11 effects the flow of liquid from the reservoir 12 through the sponge head 12 to the bottom face thereof.

In FIGS. 3 to 5 of the drawing there is illustrated another embodiment of the present invention which differs from that first described primarily in the reservoir closure and opening mechanism. Specifically, the modified fountain sponge device includes a sponge block head 33 which corresponds to the sponge block head 11. Superimposed in and coinciding with the top face of the sponge block head 33 is a sheet 34 which defines the bottom wall of the liquid containing reservoir 36 as will be hereinafter described.

The sheet 34 has a central liquid discharge or feed opening 37 therein and is formed of any suitable liquid impervious material such as polyolefin, polyvinyl chloride or the like. The sheet 34 is cemented or sealed to the sponge head top face in any suitable manner along the full face thereof except for a rectangular elongated passageway defining strip which extends from the discharge opening 37 to the side edge of the sponge head top face and of the coinciding edge of the sheet 34, the opposite top and bottom faces of the passageway being free of, but urged toward, each other.

The reservoir 36 which contains any desirable liquid 38, defines a handle and may be of any desired shape, for example of truncated prism shape as shown, the sheet 37 defining the bottom wall of the reservoir. The reservoir 36 includes downwardly diverging trapezoidal walls 39 which terminate at their bottoms in an outwardly directed coplanar flange 40 which coincides with and is suitably cemented to the peripheral borders of the sheet 34.

A closure member 41, is formed of a flexible band of a synthetic organic polymeric resin such as a polyolefin, polyvinyl chloride or the like and extends from outside the device 32 along the passageway between the sheet 34 and the sponge block 33 into underlying registering with the feed opening 37. The bank 41 is of greater width than the opening 37 and about the width of the passageway.

The inner end portion 42 of the band 41 is folded over to overly the adjacent portion of the band 41 and to completely cover the feed opening 37 and its peripheral border. The folded over band end portion 42 is cemented to the border of the feed opening 37 by a suitable pressure sensitive adhesive which is resistant to the liquid 38 to form a liquid tight seal and closure of the opening 37.

In the normal initial and unused condition of the fountain sponge device 32, the liquid 38 is stored in the closed reservoir 36 and prevented from dissipation by evaporation or through the sponge head 33.

The applicator device 32 is prepared for use merely by pulling the closure band 41 until it is separated from the passageway, as shown in FIG. 5. With the pulling of the band 41, the inner sections thereof underlying the folded over inner end section 42 pulls on the folded end to roll it outwardly to separate and raise successive end portions of the band end section 42 from the border of the feed opening 37 to break the adhesive securement thereto. With the full release and extension of the folded band end section 42, the pull in the band 41 is continued until it is fully removed from the passageway, the feed opening 37 being totally uncovered and liquid communication between the sponge head 33 and the reservoir 36 effected.

The present invention allows easy and rapid assembly since the reservoirs are vacuum formed and continuous as they pass below the liquid applying unit, the strips are then applied and the foam applicator tip.

While the apex 19 is not affixed to sheet 13 as shown, it may be and separate the two liquid volumes or keep a liquid and powder separate until ready to use.

While there have been described and illustrated preferred embodiments of the present invention, it is apparent that numerous alterations, omissions and additions may be made without departing from the spirit thereof.

What is claimed is:

1. A fountain liquid applicator device comprising a liquid absorbent flexible porous sponge head having a top face, a flexible, frangible liquid impervious sheet overlying and secured to said sponge head top face and a liquid reservoir located atop said sheet and having a bottom opening with a peripheral border in liquid tight securement to said sheet, said reservoir including inner walls downwardly converging to an apex proximate and unattached to said sheet, whereby compression of said sponge and reservoir effects the piercing of said frangible sheet by said apex to fracture said sheet to provide a communication opening between said reservoir and said sponge head.

2. The applicator device of claim 1 wherein said sheet substantially coincides with said sponge head top face and said reservoir includes a peripheral flange surrounding said reservoir opening and coinciding with and adhered to the peripheral border of said frangible sheet.

3. The applicator device of claim 2 wherein said reservoir comprises a pair of compartments separated by said downwardly converging walls, which are defined by a pair of substantially planar panels converging downwardly to said apex, which extends medially transversely shortly above said frangible sheet.

4. The applicator device of claim 3 wherein said sheet is sealed to said sponge top face and said reservoir peripheral flange is sealed to said sheet peripheral border.

5. The applicator device of claim 4 wherein said sponge head comprises a rectangular block of flexible polyurethane foam.

* * * * *